US011445775B2

(12) United States Patent
Otey

(10) Patent No.: US 11,445,775 B2
(45) Date of Patent: Sep. 20, 2022

(54) DETACHABLE AIR COOLING DEVICE FOR HEADGEAR

(71) Applicant: William Elwood Otey, Logan, UT (US)

(72) Inventor: William Elwood Otey, Logan, UT (US)

(73) Assignee: William Elwood Otey, Magalia, CA (US)

( * ) Notice: Subject to any disclaimer, the term of this patent is extended or adjusted under 35 U.S.C. 154(b) by 1093 days.

(21) Appl. No.: 16/043,968

(22) Filed: Jul. 24, 2018

(65) Prior Publication Data

US 2018/0325199 A1 Nov. 15, 2018

Related U.S. Application Data

(63) Continuation-in-part of application No. 15/600,313, filed on May 19, 2017, now abandoned.

(Continued)

(51) Int. Cl.

| | |
|---|---|
| ***A42B 1/008*** | (2021.01) |
| ***F04D 25/06*** | (2006.01) |
| ***F04D 17/16*** | (2006.01) |
| ***F04D 25/08*** | (2006.01) |
| ***F04D 29/42*** | (2006.01) |
| ***F04D 29/62*** | (2006.01) |

(Continued)

(52) U.S. Cl.

CPC ..... *A42B 1/008* (2013.01); *F04D 17/16* (2013.01); *F04D 25/0673* (2013.01); *F04D 25/08* (2013.01); *F04D 29/4226* (2013.01); *F04D 29/601* (2013.01); *F04D 29/626* (2013.01); *A42B 3/105* (2013.01)

(58) Field of Classification Search

CPC ..... A42B 1/008; A42B 3/105; A42B 3/285; A42B 3/286; A62B 18/045; F04D 17/16; F04D 25/0673; F04D 25/08; F04D 29/0693; F04D 29/601; F04D 29/626; F04D 29/4226

See application file for complete search history.

(56) References Cited

U.S. PATENT DOCUMENTS

| | | | | |
|---|---|---|---|---|
| 9,631,804 | B1 * | 4/2017 | Glenn | F21V 33/00 |
| 2006/0072347 | A1 * | 4/2006 | Ferraro | F04D 29/601 362/808 |

(Continued)

*Primary Examiner* — Devon C Kramer
*Assistant Examiner* — Joseph S. Herrmann
(74) *Attorney, Agent, or Firm* — Thoughts To Paper

(57) ABSTRACT

A detachable air cooling device for headgear that provides a cooling effect to wearer. The cooling device includes a fan assembly, a U-shaped compression clip, and a rechargeable battery. The fan assembly includes a motorized fan and a cover housing. In particular, the fan assembly is positioned adjacent to a second leg of the U-shaped compression clip, opposite a first leg of the U-shaped compression clip. The cover housing holds the motorized fan and is adjacently mounted along the second leg. The motorized fan is mounted within the cover housing. An air intake of the fan assembly traverses into the cover housing, opposite the first leg. An air outlet of the fan assembly laterally traverses out of the cover housing to blow air directly onto the wearer's face. The rechargeable battery is mounted to the U-shaped compression clip and is electrically connected to the motorized fan.

16 Claims, 5 Drawing Sheets

Related U.S. Application Data

(60) Provisional application No. 62/339,450, filed on May 20, 2016, provisional application No. 62/537,705, filed on Jul. 27, 2017.

(51) Int. Cl.
*F04D 29/60* (2006.01)
*A42B 3/10* (2006.01)

(56) References Cited

U.S. PATENT DOCUMENTS

2012/0263611 A1* 10/2012 Lyons ..... F04D 25/0673
417/410.1
2014/0099195 A1* 4/2014 Jun ..... F04D 17/16
428/134
2014/0143934 A1* 5/2014 Grzybowski ..... A42B 3/286
2/171.3

* cited by examiner

DETACHABLE AIR COOLING DEVICE FOR HEADGEAR

The current application is a continuation-in-part (CIP) application of a U.S. non-provisional application Ser. No. 15/600,313 filed on May 19, 2017. The U.S. non-provisional application Ser. No. 15/600,313 claims a priority to a U.S. provisional application Ser. No. 62/339,450 filed on May 20, 2016.

FIELD OF THE INVENTION

The present invention relates generally to headwear. More specifically, the present invention is a detachable air cooling device for headgear. The present invention essentially mounts a centrifugal fan to headgear, such as a ball cap, in order to effectively blow cool air onto a wearer's face.

BACKGROUND OF THE INVENTION

There are other fan-based cooling devices for headwear on the market which provide a wearer with moving air about his or her face. The present invention can most clearly be distinguished from these designs through the use of a centrifugal fan and the placement of said fan and how this differs from somewhat similar devices. Additionally, the present invention is not integrated into the headwear, the present invention is a detachable device. The present invention provides an easily detachable means of cooling one's face without obstructing the user's view and without adding significant weight to the user's headwear. Furthermore, humidity is a very important factor for cooling device as humidity inhibits the evaporative cooling process. Many traditional designs utilize propeller fans integrated into the rim of the headwear. Resultantly, the user must wear that specific headwear. The present invention provides a detachable means of cooling, thus allowing the user to wear any headwear he or she chooses. Additionally, the fans from these kinds of designs pull air from around the head and blow the air back onto the user's head. In the case of these designs, the fan is receiving humidity from the head which therefore inhibits the evaporative cooling effect. Contrary to this, the fan of the present invention pull air from outside of, and away from the head (as much as possible) so that most humidity from the head is not circulated by the fans and therefore most humidity from the head is not inhibiting the evaporative cooling process.

Some somewhat similar devices employ a box-fan (propeller) type of construction that clips onto the brim of a hat and pulls air from out and away from the head and blows the air onto the face. The present invention employs a centrifugal fan that slides underneath the brim using a different kind of mechanical means to convey air onto the forehead and face of the wearer of a hat. The centrifugal fan lays flat underneath the brim so as not to obstruct sight. Resultantly, the present invention is streamlined and compact. The present invention provides an easy and effective means of attachment. More specifically, the present invention utilizes a clip-like mechanism in order to attach directly under the bill of a hat, away from the high humidity region of the head.

DETAIL DESCRIPTIONS OF THE INVENTION

All illustrations of the drawings are for the purpose of describing selected versions of the present invention and are not intended to limit the scope of the present invention.

The present invention generally relates to headwear. More specifically, the present invention is a detachable air cooling device for headgear. In particular, the present invention is designed to attach to a brim of a hat, such as a ball cap, to blow air directly onto the face and head area of a wearer. Although, the present invention may be attach to any type of headgear with a ridged brim. This disclosure depicts the attachment of the present invention to a ball cap, in particular the brim of said ball cap, for simplicity purposes; this in no way is meant to limit the scope of the present invention.

Figure 1:
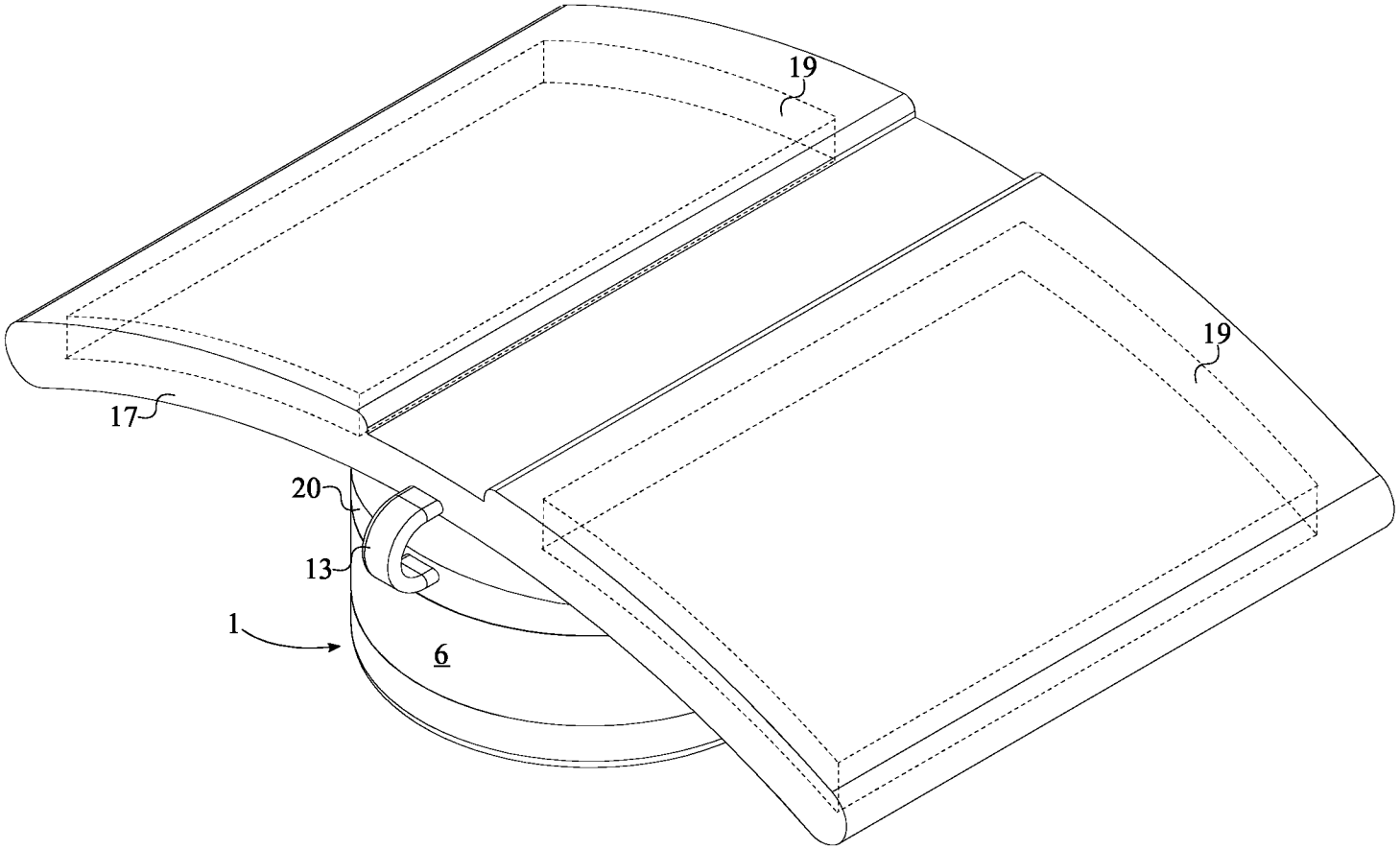
FIG. 1 is a perspective view of the present invention.

Referring to FIG. 1, the present invention comprises a fan assembly 1, an at least one U-shaped compression clip 13, a rechargeable battery 19, and a bracing plate 17. The U-shaped compression clip 13 attaches the present invention to the brim of a hat and ensures that the present invention is stable and secure during any type of quick movement performed by the wearer. The U-shaped compression clip 13 is a fastening mechanism that comprises a first leg 14, a second leg 15, and an intermediate web section 16. More specifically, the first leg 14 and the second leg 15 are positioned parallel and opposite to each other across the intermediate web section 16. The intermediate web section 16 is terminally connected in between the first leg 14 and the second leg 15 in order to yield a U-shaped structure. The space delineated by the first leg 14, the second leg 15, and the intermediate web section 16 receives the brim, thus securing the present invention to the hat. It is preferred that the U-shaped compression clip 13 is composed of a ridged metallic material, although alternative materials may also be utilized. This allows for minor displacement between the first leg 14 and the second leg 15, thus creating a compression force in between the first leg 14 and the second leg 15. Additionally, the length, width, and height of the U-shaped compression clip 13 is subject to change to fit a variety of different hat designs. In an alternative embodiment, springs and other similar compression mechanisms may be integrated in between the first leg 14, the second leg 15, and the intermediate web section 16 which further secure the present invention to the hat.

The fan assembly 1 produces air flow in a specific direction in order to provide a cooling and evaporating effect onto the user's face. The fan assembly 1 comprises a motorized fan 2, a cover housing 6, an air intake 10, and an air outlet 12. The fan assembly 1 is positioned adjacent to the second leg 15, opposite to the first leg 14. More specifically, the motorized fan 2 is mounted within the cover housing 6 and creates an air flow through and around the cover housing 6. The cover housing 6 encloses and protects the motorized fan 2. The cover housing 6 is adjacently mounted along the second leg 15. This positions the fan assembly 1 directly under the brim while the first leg 14 and the intermediate web section 16 wrap around the brim. Additionally, the cover housing 6 directs air flow created by the motorized fan 2 directly onto the user. The air intake 10 and the air outlet 12 expose the motorized fan 2 within the cover housing 6 to the external surrounding such that air may be pulled in and redirected by the motorized fan 2. The air intake 10 traverses into the cover housing 6, opposite the first leg 14, to provide the motorized fan 2 with access to air around the brim. The air outlet 12 laterally traverses out of the cover housing 6 to redirect air captured by the fan assembly 1 directly onto the user, specifically the face of the user. This is especially useful for defogging glasses or goggles.

Figure 5:
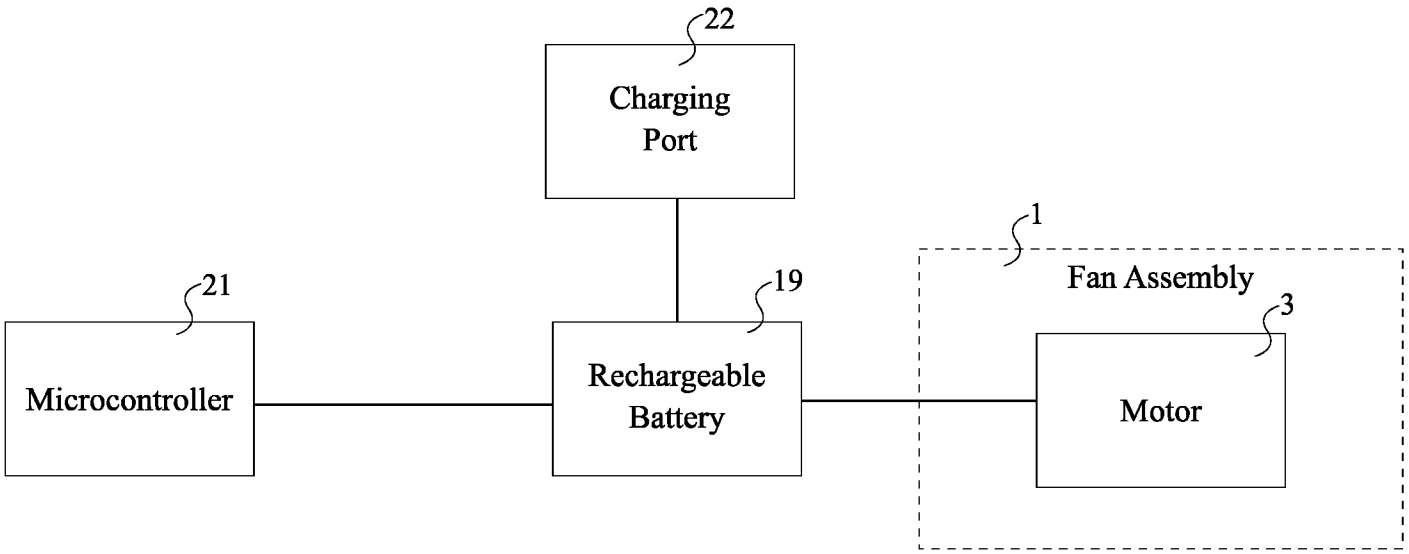
FIG. 5 is an electric schematic of the present invention.

Referring to FIG. 5, the rechargeable battery 19 provides the electrical energy needed to power the fan assembly 1. The rechargeable battery 19 is mounted to the U-shaped compression clip 13 and is electrically connected to the motorized fan 2. In one embodiment of the present invention, the rechargeable battery 19 is mounted adjacent to the first leg 14. In another embodiment of the present invention, the rechargeable battery 19 is mounted to the second leg 15. Furthermore, in one embodiment, the rechargeable battery 19 is a simple one time use battery.

Referring to FIG. 1, in the preferred embodiment of the present invention, the rechargeable battery 19 is mounted to the first leg 14 through a bracing plate 17. The bracing plate 17 is a planar housing that supports the rechargeable battery 19. Additionally, the bracing plate 17 extends the engagement surface between the U-shaped compression clip 13 and the top surface of the brim to yield a more secure connection. More specifically, the bracing plate 17 is adjacently mounted along the first leg 14, opposite to the fan assembly 1, such that when the present invention is attached to the brim, the bracing plate 17 sits atop of the brim. The bracing plate 17 extends along the first leg 14 to further increase the engagement surface between the bracing plate 17 and the top of the brim. The rechargeable battery 19 is integrated into the bracing plate 17. For this, the bracing plate 17 is an elongated and hollow rectangular structure which houses and protects the rechargeable battery 19 inside. The bracing plate 17 is additionally designed to complement the curvature of traditional ball caps. In particular, the bracing plate 17 comprises a bottom surface 18, wherein the bottom surface 18 is a concave surface. The bottom surface 18 is positioned adjacent to the intermediate web section 16 such that when the present invention is attached to the brim, the bottom surface 18 is fully pressed against the top surface of the brim, thus reducing any possible lateral movement of the present invention in response to the user's movement.

Figure 2:
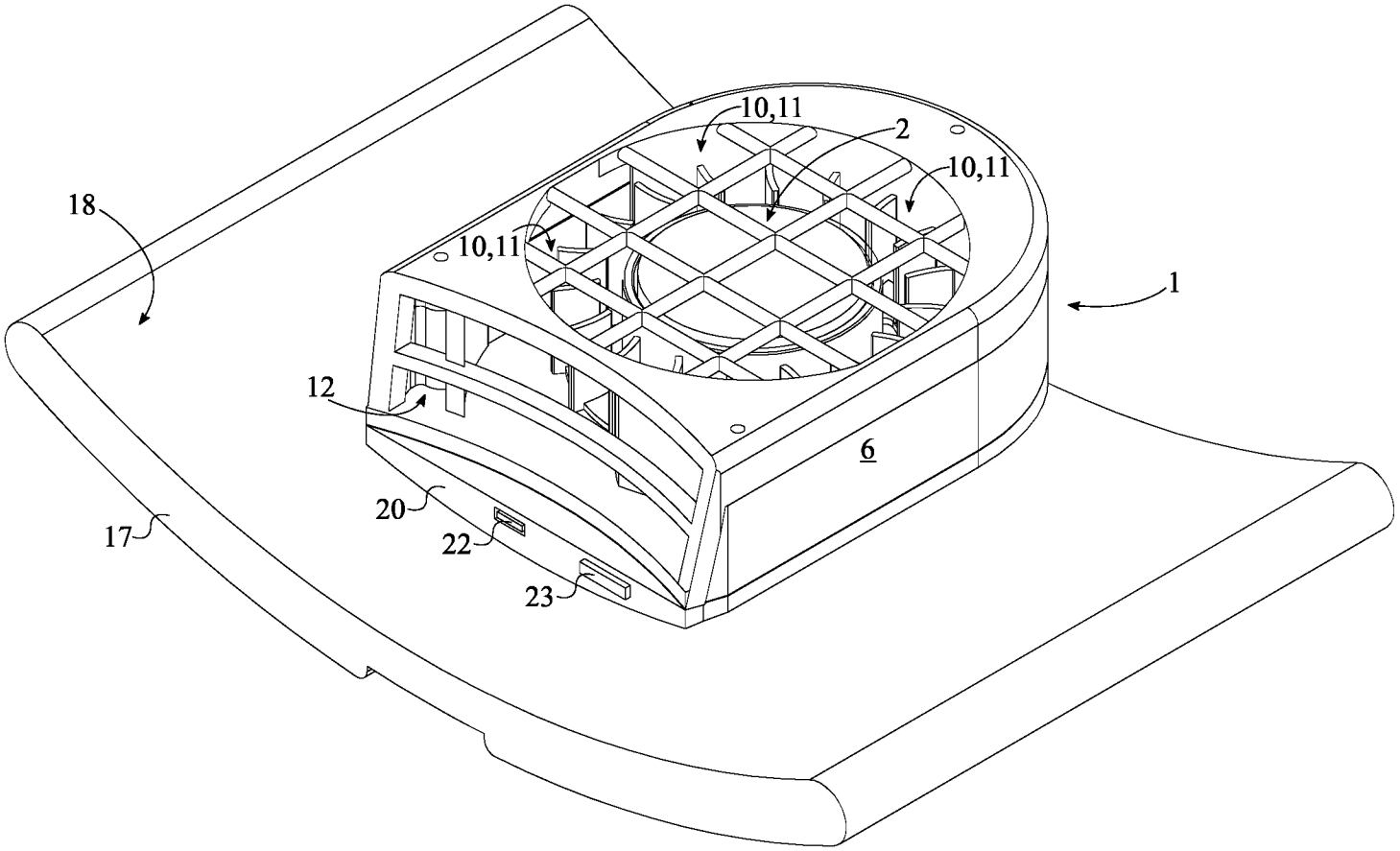
FIG. 2 is a bottom perspective view of the present invention.
Figure 4:
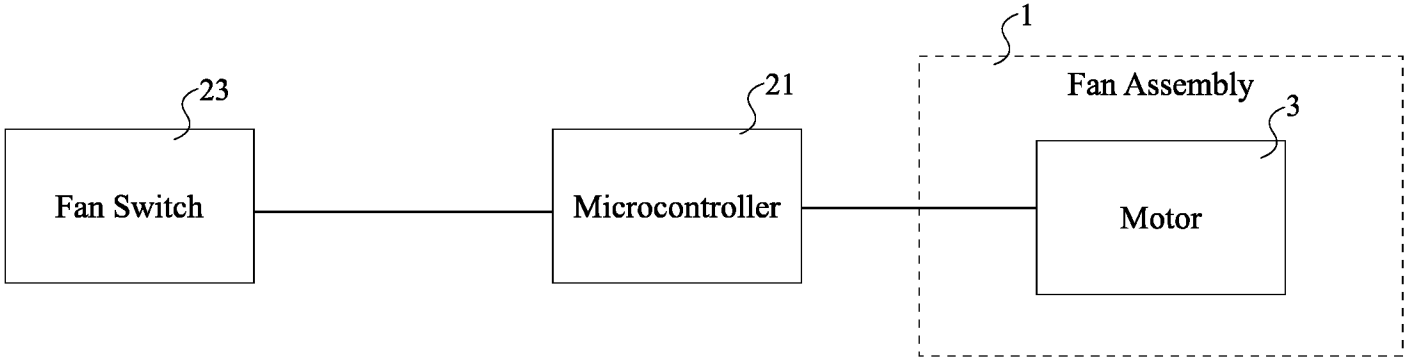
FIG. 4 is an electronic schematic of the present invention.

Referring to FIG. 2 and FIG. 4, the present invention further comprises a control-unit housing 20, a microcontroller 21, a fan switch 23, and a charging port 22. The control-unit housing 20 supports and protects the electrical control components of the present invention. Additionally, the control-unit housing 20 acts as a backing for the bracing plate 17 to yield a secure attachment between the present invention and the brim. The control-unit housing 20 is positioned in between the cover housing 6 and the second leg 15. Additionally, the control-unit housing 20 is adjacently connected to the cover housing 6. Opposite the cover housing 6, the second leg 15 is adjacently connected to the control-unit housing 20. It is preferred that the second leg 15 is connected flush with the control-unit housing 20 such that the top surface of the control-unit housing 20 fully presses against the bottom surface of the brim. The fan switch 23 is a button which turns on and turns off the motorized fan 2. For easy access, the fan switch 23 is laterally mounted to the control-unit housing 20. The microcontroller 21 is a small computer on an integrated circuit that executes a set of commands to control the electronic components of the present invention. The microcontroller 21 is internally mounted within the control-unit housing 20 for protection against environmental factors. The microcontroller 21 is electronically connected to the motorized fan 2, and the fan switch 23. Additionally, the rechargeable battery 19 is electrically connected to microcontroller 21.

The charging port 22 provides a means of charging the rechargeable battery 19 for continual use of the motorized fan 2. More specifically, the charging port 22 is any industry standard connector or protocol for power supplies such as lightning port, USB, USB type C, and other similar connectors. The charging port 22 is laterally integrated into the control-unit housing 20 and is electrically connected to the rechargeable battery 19. Although, in alternative embodiments of the present invention, the charging port 22 may be integrated into different components and areas for easy point of access or personal preferences.

Figure 3:
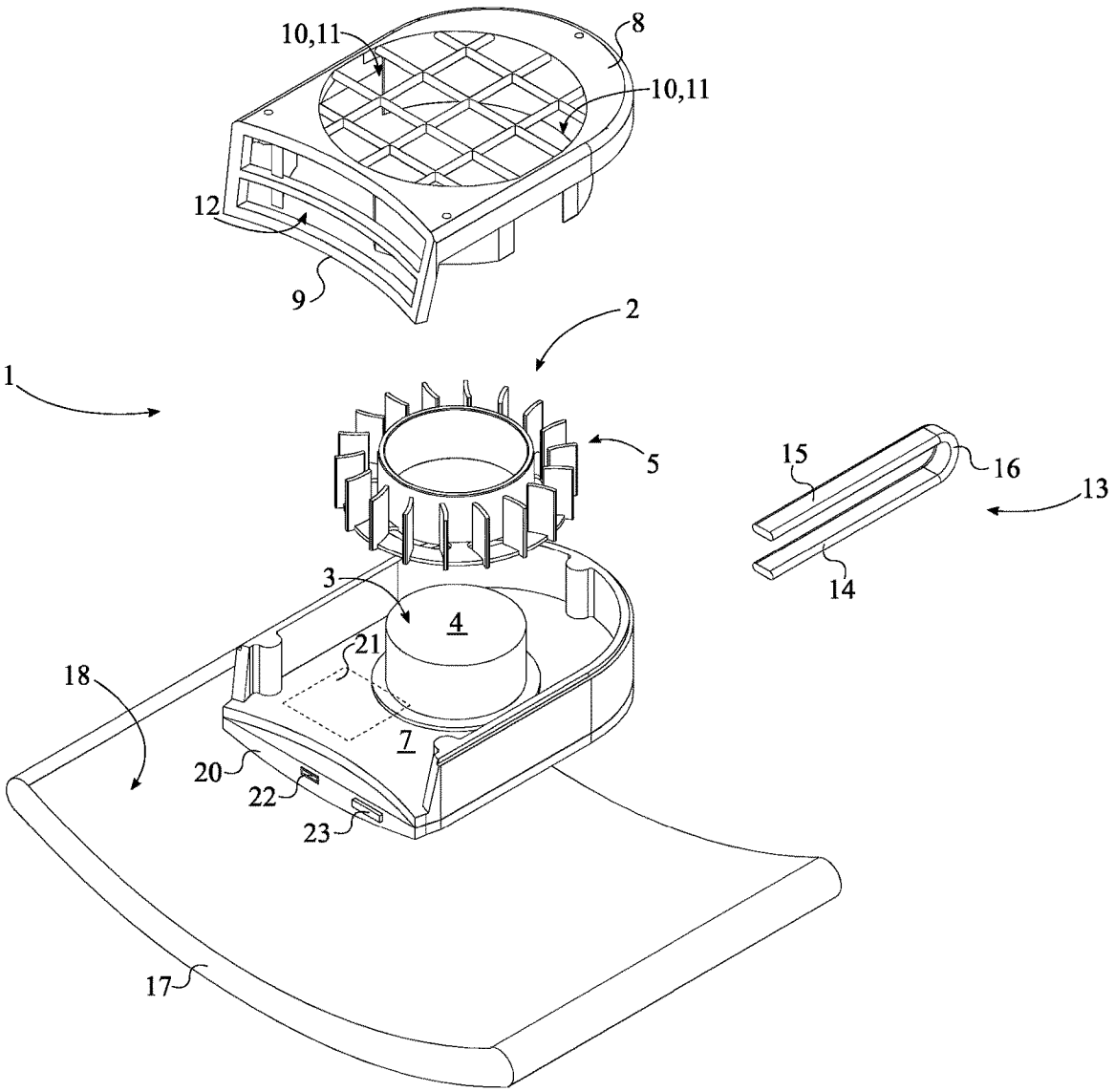
FIG. 3 is a bottom perspective view of the present invention in an exploded state.

Referring to FIG. 3, the motorized fan 2 preferably comprises a motor 3 and a centrifugal fan 5. One of the main advantages of the present invention over similar designs is the centrifugal fan 5. The small profile characteristics of the centrifugal fan 5 provide the user with adequate cooling without significantly obstructing his or her view. The centrifugal fan 5 displaces air radially and, when compared to traditional box fans/impellers, is sturdier and more reliable. The motor 3 is an electrical device which converts electrical energy into mechanical energy, specifically rotational translation. The motor 3 is normally mounted to a top sidewall 7 of the cover housing 6; wherein the top sidewall 7 is positioned adjacent to the second leg 15. The centrifugal fan 5 is axially and rotatably connected to a stator 4 of the motor 3 such that the radial translation produced by the motor 3 is transferred to the centrifugal fan 5. The motor 3 is powered by the rechargeable battery 19; thus, the rechargeable battery 19 is electrically connected to the motor 3. Additionally, the microcontroller 21 is electronically connected to the motor 3. Resultantly, the fan assembly 1 pulls in air along the rotational axis of the centrifugal fan 5 and blows air out laterally at a 90 degree to the rotational axis of the centrifugal fan 5. For this configuration, the air intake 10 comprises a plurality of inlet holes 11. The plurality of inlet holes 11 exposes the centrifugal fan 5 within the housing cover to the air outside the housing cover. The plurality of inlet holes 11 is distributed about a bottom sidewall 8 of the cover housing 6; wherein, the bottom sidewall 8 is positioned opposite to the second leg 15, across the cover housing 6; and the bottom sidewall 8 is oriented perpendicular to the rotational axis of the centrifugal fan 5. Referring to FIG. 2, each of the plurality of inlet holes 11 normally traverses through the bottom sidewall 8.

In order to blow air towards the user's face, the air output is integrated into a rear sidewall 9 of the cover housing 6. The rear sidewall 9 is positioned opposite to the intermediate web section 16, along the cover housing 6. Resultantly, when the present invention is attached to the hat, the rear sidewall 9 is oriented directly towards the user's face. Specifically, the air output laterally traverses out through the rear sidewall 9. The air output may comprise a multitude of small holes or a single large hole. This configuration orients the air intake 10 and the air outlet 12 perpendicular to each other, aligning with the inlet and outlet characteristics of the centrifugal fan 5.

In one embodiment of the present invention, the at least one U-shaped compression clip 13 comprises a first clip and a second clip. This first clip and the second clip are linearly distributed along a front edge of the cover housing 6 to provide symmetrical support to the present invention when the present invention is attached to the brim. In an alternative embodiment of the present invention, the rechargeable battery 19 is integrated into the cover housing 6 or the control-unit housing 20. Resultantly, when the present invention is attached to the brim, the rechargeable battery 19 is located under the brim.

Although the invention has been explained in relation to its preferred embodiment, it is to be understood that many other possible modifications and variations can be made without departing from the spirit and scope of the invention as hereinafter claimed.

What is claimed is:

1. A detachable air cooling device for headgear comprises:

a fan assembly;

an at least one U-shaped compression clip;

a rechargeable battery;

a control-unit housing;

a microcontroller;

a fan switch;

the U-shaped compression clip comprises a first leg, a second leg, and an intermediate web section;

the fan assembly comprises a motorized fan, a cover housing, an air intake, and an air outlet;

the first leg and the second leg being positioned parallel and opposite to each other, across the intermediate web section;

the intermediate web section being terminally connected in between the first leg and the second leg;

the fan assembly being positioned adjacent to the second leg, opposite to the first leg;

the cover housing being adjacently mounted along the second leg;

the motorized fan being mounted within the cover housing;

the air intake traversing into the cover housing, opposite to the first leg;

the air outlet laterally traversing out of the cover housing;

the rechargeable battery being mounted to the U-shaped compression clip;

the rechargeable battery being electrically connected to the motorized fan:

the control-unit housing being positioned in between the cover housing and the second leg;

the control-unit housing being adjacently connected to the cover housing;

the second leg being adjacently connected to the control-unit housing, opposite the cover housing;

the fan switch being laterally mounted to the control-unit housing;

the microcontroller being internally mounted within the control-unit housing;

the microcontroller being electronically connected to the motorized fan and the fan switch; and the rechargeable battery being electrically connected to the microcontroller.

2. The detachable air cooling device for headgear as claimed in claim 1 comprises:

a charging port;

the control-unit housing being positioned in between the cover housing and a bracing plate;

the control-unit housing being adjacently connected to the cover housing;

the second leg being adjacently connected to the control-unit housing, opposite the cover housing;

the charging port being laterally integrated into the control-unit housing; and the charging port being electrically connected to the rechargeable battery.

3. The detachable air cooling device for headgear as claimed in claim 1 comprises:

the cover housing comprises a top sidewall;

the motorized fan comprises a motor and a centrifugal fan;

the top sidewall being positioned adjacent to the second leg;

the motor being normally mounted to the top sidewall;

the centrifugal fan being axially and rotatably connected to a stator of the motor; and the rechargeable battery being electrically connected to the motor.

4. The detachable air cooling device for headgear as claimed in claim 1 comprises:

the cover housing comprises a bottom sidewall;

the air intake comprises a plurality of inlet holes;

the bottom sidewall being positioned opposite to the second leg, across the cover housing;

the plurality of inlet holes being distributed about the bottom sidewall; and each of the plurality of inlet holes normally traversing through the bottom sidewall.

5. The detachable air cooling device for headgear as claimed in claim 1 comprises:

the cover housing comprises a rear sidewall;

the rear sidewall being positioned opposite to the intermediate web section, along the cover housing; and the air outlet laterally traversing out through the rear sidewall.

6. The detachable air cooling device for headgear as claimed in claim 1, wherein the air intake and the air outlet are oriented perpendicular to each other.

7. The detachable air cooling device for headgear as claimed in claim 1 comprises:

a bracing plate;

the bracing plate being adjacently mounted along the first leg, opposite the fan assembly;

the bracing plate extending along the first leg;

a bottom surface of the bracing plate being positioned adjacent to the intermediate web section; and the bottom surface being a concave surface.

8. The detachable air cooling device for headgear as claimed in claim 1, wherein the rechargeable battery is integrated into a bracing plate.

9. A detachable air cooling device for headgear comprises:

a fan assembly;

an at least one U-shaped compression clip;

a rechargeable battery;

a bracing plate;

the U-shaped compression clip comprises a first leg, a second leg, and an intermediate web section;

the fan assembly comprises a motorized fan, a cover housing, an air intake, and an air outlet;

the first leg and the second leg being positioned parallel and opposite to each other, across the intermediate web section;

the intermediate web section being terminally connected in between the first leg and the second leg;

the fan assembly being positioned adjacent to the second leg, opposite to the first leg;

the cover housing being adjacently mounted along the second leg;

the motorized fan being mounted within the cover housing;

the air intake traversing into the cover housing, opposite to the first leg;

the air outlet laterally traversing out of the cover housing;

the rechargeable battery being mounted to the U-shaped compression clip;

the rechargeable battery being electrically connected to the motorized fan;

the bracing plate being adjacently mounted along the first leg, opposite the fan assembly;

the bracing plate extending along the first leg;

a bottom surface of the bracing plate being positioned adjacent to the intermediate web section; and the bottom surface being a concave surface.

10. The detachable air cooling device for headgear as claimed in claim 9 comprises:

a control-unit housing;

a microcontroller;

a fan switch;

the control-unit housing being positioned in between the cover housing and the second leg;

the control-unit housing being adjacently connected to the cover housing;

the second leg being adjacently connected to the control-unit housing, opposite the cover housing;

the fan switch being laterally mounted to the control-unit housing;

the microcontroller being internally mounted within the control-unit housing;

the microcontroller being electronically connected to the motorized fan and the fan switch; and the rechargeable battery being electrically connected to the microcontroller.

11. The detachable air cooling device for headgear as claimed in claim 9 comprises:

a charging port;

a control-unit housing;

the control-unit housing being positioned in between the cover housing and the bracing plate;

the control-unit housing being adjacently connected to the cover housing;

the second leg being adjacently connected to the control-unit housing, opposite the cover housing;

the charging port being laterally integrated into the control-unit housing; and the charging port being electrically connected to the rechargeable battery.

12. The detachable air cooling device for headgear as claimed in claim 9 comprises:

the cover housing comprises a top sidewall;

the motorized fan comprises a motor and a centrifugal fan;

the top sidewall being positioned adjacent to the second leg;

the motor being normally mounted to the top sidewall;

the centrifugal fan being axially and rotatably connected to a stator of the motor; and the rechargeable battery being electrically connected to the motor.

13. The detachable air cooling device for headgear as claimed in claim 9 comprises:

the cover housing comprises a bottom sidewall;

the air intake comprises a plurality of inlet holes;

the bottom sidewall being positioned opposite to the second leg, across the cover housing;

the plurality of inlet holes being distributed about the bottom sidewall; and each of the plurality of inlet holes normally traversing through the bottom sidewall.

14. The detachable air cooling device for headgear as claimed in claim 9 comprises:

the cover housing comprises a rear sidewall;

the rear sidewall being positioned opposite to the intermediate web section, along the cover housing; and the air outlet laterally traversing out through the rear sidewall.

15. The detachable air cooling device for headgear as claimed in claim 9, wherein the air intake and the air outlet are oriented perpendicular to each other.

16. The detachable air cooling device for headgear as claimed in claim 9, wherein the rechargeable battery is integrated into the bracing plate.

* * * * *